US008516943B2

(12) United States Patent
Rogers

(10) Patent No.: US 8,516,943 B2
(45) Date of Patent: Aug. 27, 2013

(54) TELE-OPERATED, INTRINSICALLY STABLE PAN/TILT MOUNT FOR REMOTE OPERATION OF WEAPONS OR TOOLS

(76) Inventor: Chris Rogers, Louisville, CO (US)

( * ) Notice: Subject to any disclaimer, the term of this patent is extended or adjusted under 35 U.S.C. 154(b) by 127 days.

(21) Appl. No.: 13/341,656

(22) Filed: Dec. 30, 2011

(65) Prior Publication Data

US 2012/0174741 A1 Jul. 12, 2012

Related U.S. Application Data

(60) Provisional application No. 61/431,526, filed on Jan. 11, 2011, provisional application No. 61/505,963, filed on Jul. 8, 2011.

(51) Int. Cl.
*F41G 5/02* (2006.01)

(52) U.S. Cl.
USPC ..... 89/41.15; 89/41.17; 89/41.02

(58) Field of Classification Search
USPC ..... 89/41.17, 41.15, 41.02, 40.04, 41.05, 89/41.07, 41.08
See application file for complete search history.

(56) References Cited

U.S. PATENT DOCUMENTS

| | | | | |
|---|---|---|---|---|
| 7,168,357 | B2 * | 1/2007 | Hodgkinson | 89/1.11 |
| 8,397,621 | B2 * | 3/2013 | Hodge | 89/41.05 |
| 2010/0263524 | A1 * | 10/2010 | Morin et al. | 89/27.12 |

* cited by examiner

*Primary Examiner* — Stephen M Johnson
(74) *Attorney, Agent, or Firm* — Plager Schack LLP

(57) ABSTRACT

This is directed to systems, processes, machines, and other means that allow a pan/tilt gun mount to be radio controlled by a plurality of frequencies. The invention can rapidly rotate and adjust elevation to aim a gun mount as directed by a user.

10 Claims, 3 Drawing Sheets

TELE-OPERATED, INTRINSICALLY STABLE PAN/TILT MOUNT FOR REMOTE OPERATION OF WEAPONS OR TOOLS

CROSS REFERENCE TO RELATED APPLICATIONS

This application claims priority to Provisional application 61/431,526, filed on Jan. 11, 2011; and to Provisional application 61/505,963, filed on Jul. 8, 2011.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION BY REFERENCE OF MATERIAL SUBMITTED ON A COMPACT DISC

Not Applicable

FIELD OF THE INVENTION

This devise relates to remote controlled vehicles and equipment.

BACKGROUND OF THE INVENTION

This device provides improvements to remote control technology for mounting and operating target devices such as paintball guns, sandblasters and fire-fighting equipment. While this primarily relates to non-lethal technology, it can be also used for lethal technology. Current technology in this field require complicated machines for rotating target devices and adjusting their elevation, if any comprehensive solution is offered at all. Where a solution exists, it involves a complicated device with a large number of moving parts rendering the device susceptible to a large number of repairs.

The proposed invention eliminates those problems by using a series of motors, each controlled by a separate radio frequency, which can adjust the elevation, and rotational direction of the target device along with firing the device.

BACKGROUND ART

The Morin U.S. Pat. No. 7,974,736 teaches a remotely controlled device that can fire a gun; however, it does not contain technology to change the direction or elevation of the target device without changing the direction of the entire vehicle.

The Fisk U.S. Pat. No. 7,895,930 teaches a remotely controlled device that can fire a gun; however, the technology disclosed mostly relates to how to prevent recoil problems with high force weapons. The present invention solves that problem by lowering the center of gravity, additionally, it does not contain technology to change the direction or elevation of the target device without changing the direction of the entire vehicle.

The Berkovich U.S. Pat. App. No. 2008/0053300 A1 teaches a remotely controlled device that can fire a gun; however, it only teaches how to change the elevation of the target device and does not teach how to change the direction of the target device without changing the direction of the entire vehicle.

BRIEF SUMMARY OF THE INVENTION

Methods, systems, and other means are provided for remote controlled vehicles and equipment. In accordance with some embodiments, the invention has at least three controlled mechanisms 1) a firing mechanism; 2) an elevation mechanism and 3) a rotation mechanism. Each portion is separately controlled by a different radio frequency that can be used from a single remote controller.

BRIEF DESCRIPTION OF THE SEVERAL VIEWS OF THE DRAWINGS

Figure 1:
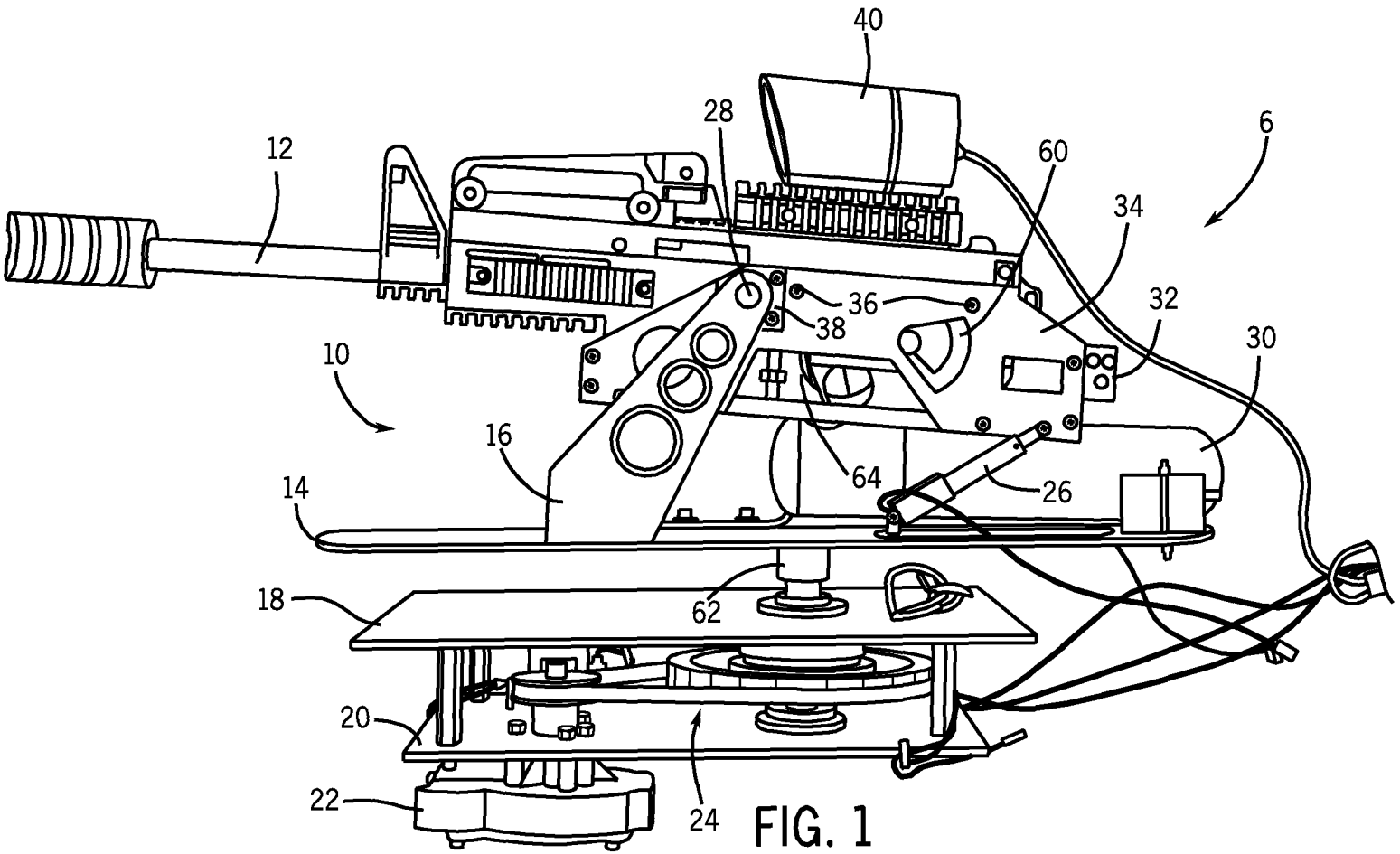

Having thus described the invention in general terms, reference will now be made to the accompanying drawings, which are not necessarily drawn to scale, and wherein:

FIG. 1: is a perspective view of the invention.

Figure 2:
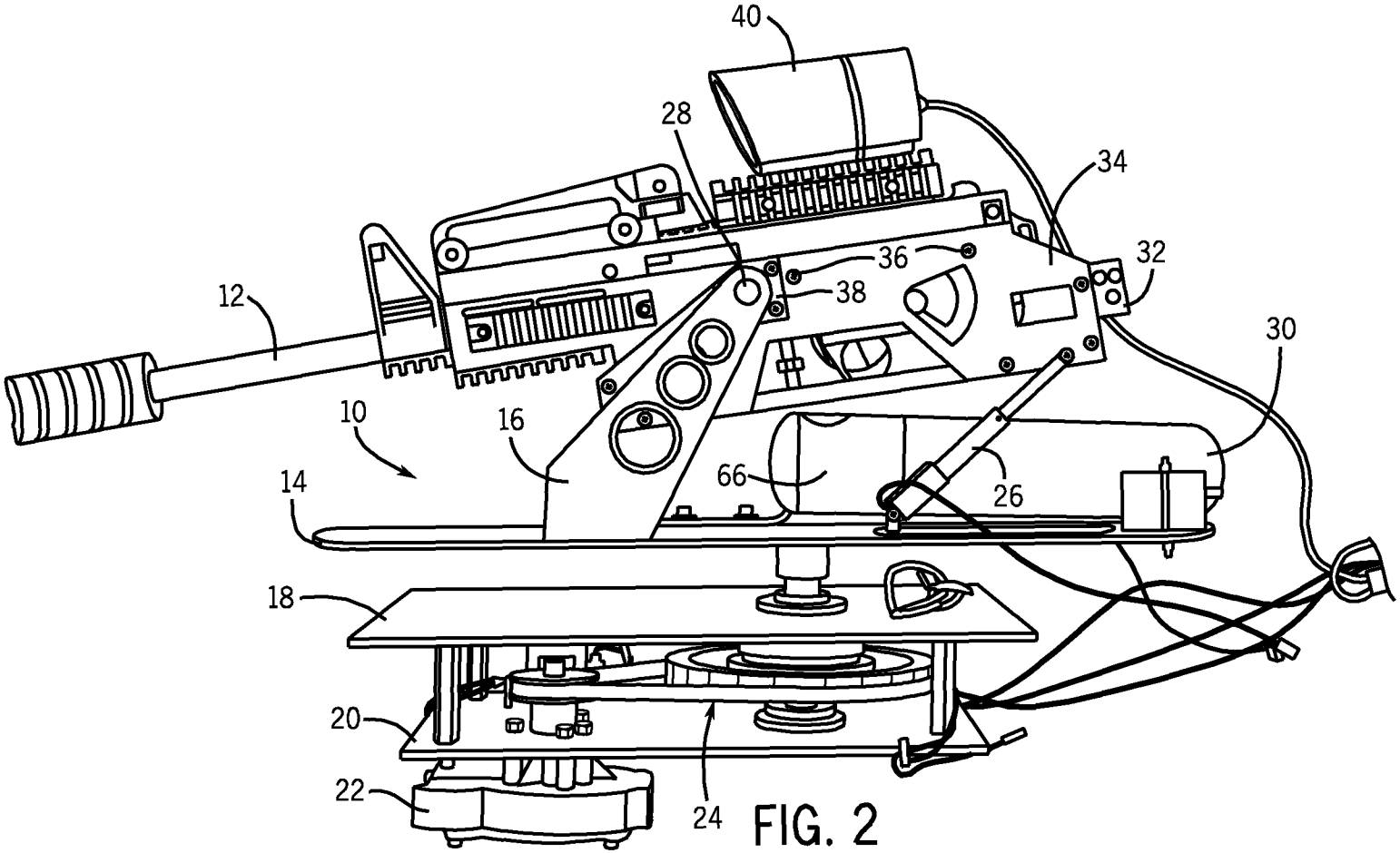

FIG. 2: is a perspective view showing the invention in a second orientation.

Figure 3:
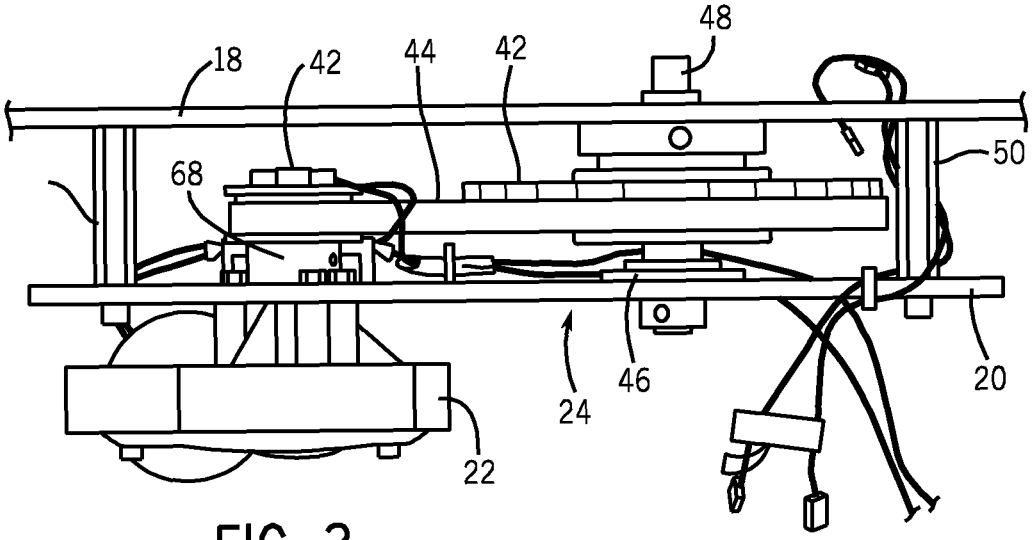

FIG. 3: is a side elevation view of the lower structure of the invention.

Figure 4:
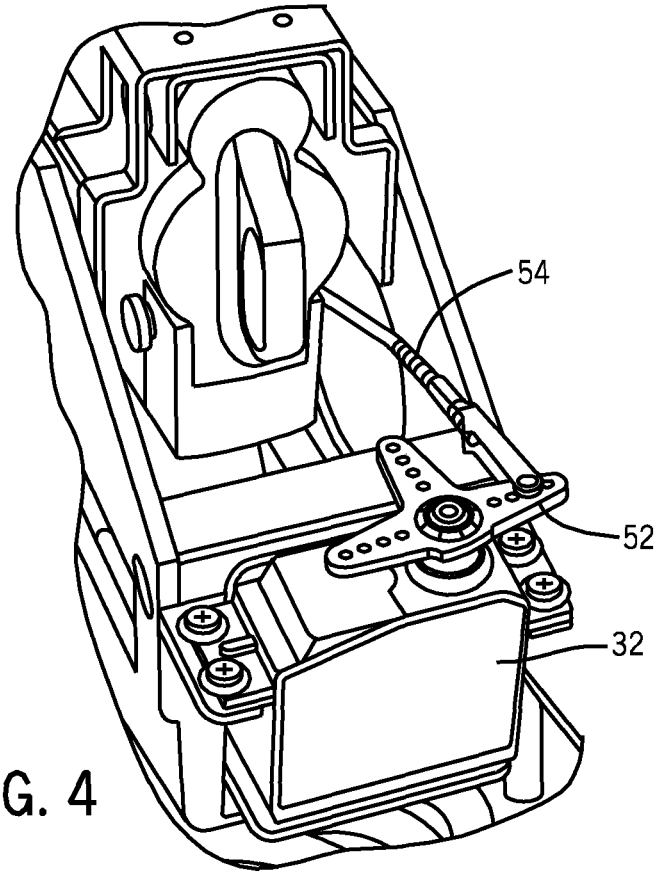

FIG. 4: is a rear detail perspective view.

DETAILED DESCRIPTION OF THE INVENTION

Embodiments of the present invention overcome many of the obstacles associated with remote-controlled vehicles with numerous remote controlled portions, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows mount invention 10. Central to mount invention 10 is deck 14. Deck 14 contains a hole and can be manufactured, for instance with a punch press. Deck 14 contains hub attachment point 62. Hub attachment point 62 is mechanically coupled to upper mounting plate 18. Upper mounting plate 18 can be manufactured with a drill press and a band saw. Upper mounting plate 18 can be the roof or a car, or other vehicle. Beneath upper mounting plate 18, hub attachment point 62 is mechanically coupled to drive mechanism 24. Drive mechanism 24 is mechanically coupled to motor 22 through a pan shaft (not shown) which goes through lower mounting plate 20. See FIG. 3.

Motor 22 turns drive mechanism 24 which causes hub attachment point 62 to rotate. As hub attachment point 62 rotate, deck 14 rotates. This assembly enables a user to control the direction of weapon 12 which can be rotated 360 degrees in order that weapon 12 can be pointed at a target in any planar relative direction to weapon 12. This is explained in greater detail in FIG. 3.

Deck 14 is mechanically coupled to gun cradle 6 by vertical towers 16. Vertical towers 16 can be welded to Deck 14 or attached in some similar fixed manner. Vertical towers 16 are mechanically coupled to precision ground shaft 28, which is an aftermarket component. Parallel plates 34 are mechanically coupled to precision shaft 28 by pivot bearing plates 38.

Parallel plates 34 are mechanically coupled to weapon 12 by weapon fasteners 36. Parallel plates 38 can be manufactured with a CNC mill.

One of the inventive features of this device is the ability for it to be reconfigured. For example, weapon fasteners 36 can be removed. At that point weapon 12 can be replaced with any target device such as a paintball gun, sand blaster, flamethrower, fire extinguisher, or grenade launcher, which can then be reattached to the device by weapon fasteners 36. Cutouts in parallel plates 34 allow the user to easily access, maintain, repair or disassemble mount invention 10.

Deck 14 is mechanically coupled to elevation control device 26. Elevation control device 26 can be radio controlled to expand or contract causing the direction of weapon 12 to be changed to accommodate user preference with a first radio signal. Deck 14 is mechanically attached to magazine 30 which provides ammunition for weapon 12. One of the distinct advantages of radio control is that the operator need not be nearby in order to operate the device. This is particularly important in dangerous activities such as firefighting and sandblasting where the user has a greater likelihood of facing harm the closer the user is to the mount invention 10.

Parallel plates 34 are mechanically coupled to trigger firing mechanism 32 which is explained in more detail in FIG. 4. Parallel plates 34 contain safety cut-out hole 60 which allows access to the safety mechanism of weapon 12 without having to disassemble the device. One of the novel features of this device is the ability to access parts without having to disassemble it. Similarly, this makes the device intuitive to repair and maintain.

Barrel camera 40 is mechanically coupled to weapon 12. Barrel camera 40 can be any aftermarket camera which can let a user see in the same omnidirectional manner as weapon 12 can rotate. Barrel camera 40 can be a plethora of devices including a wide range camera, a plurality of cameras, a camera and a rangefinder or a camera and a laser sight among other possible choices. Barrel camera 40 or the chosen peripheral device can also be radio controlled by a fourth radio frequency.

FIG. 2 shows another view of mount invention 10. In particular, with regard to the elevation mechanism, elevation control device 26 has lifted parallel plates 34 relative to deck 14 in the area of magazine 30. This has caused the barrel of weapon 12 to point downward in the direction of deck 14 in the area opposite magazine 30. This is because elevation control device 26 causes weapon 12 to rotate about precision ground shaft 28. Elevation control device 26 can be controlled by a second radio signal.

One of the advantages of the configuration in FIG. 2 is that mount invention 10 will have intrinsic stability due to a low center of gravity. This is because the center of gravity of gun cradle 6 is lower than the center of rotation which is at precision ground shaft 28. The weapon or mechanism in the gun cradle 6 is in balance on the precision ground shaft 28. This substantially increases stability and eliminates the need for heavy duty control mechanisms compared to devices currently existing in the art.

FIG. 2 shows auto feed mechanism 66. Auto feed mechanism 66 is a device, which automatically supplies ammunition to weapon 12. Auto feed mechanism 66 allows the operator to quickly exchange a first type of ammunition for a second type of ammunition or replace a depleted magazine 30 by inserting a new loaded cartridge into magazine 30. This allows ammunition such as non-lethal paintballs to be automatically fed into the weapon and facilitates rapid exchange of ammunition types.

FIG. 3 shows the rotation mechanism in more detail. Motor controller 68 receives a third radio signal from a user that causes an internal relay to activate which engages motor 22. Motor 22 has its output torque increased and horsepower decreased by reduction pulleys 42. Reduction pulleys 42 turn belt 44. Belt 44 turns pan shaft 48. Pan shaft 48 is mechanically coupled to lower mounting plate 20 by flange bearing 46.

Users can adjust reduction pulleys 42 to increase torque and decrease horsepower to accommodate user preference. Similarly, if more horsepower and torque are desired a user could accomplish this by utilizing a more powerful motor 22.

In FIG. 4 trigger firing mechanism 32 receives a first radio signal, which activates an internal relay that allows trigger firing mechanism 32 to rotate trigger arm 52. Trigger arm 52 is mechanically coupled to cable 54 which is mechanically coupled to weapon 12 (not shown). When trigger arm 52 engages cable 54, weapon 12 (not shown) activates. One of the advantages of the relatively few parts needed to activate weapon 12 is that the device is easy to use, maintain, repair and disassemble.

That which is claimed:

1. A device, comprising a rotation mechanism further comprising;

a motor mechanically coupled to a motor controller where the motor is mechanically coupled to a pan shaft; and where the motor controller receives a first radio signal;

an elevation mechanism further comprising;

an elevation control device mechanically coupled to a gun cradle where the elevation control device is mechanically coupled to a deck; and where the elevation control device receives a second radio signal to the elevation control device;

a firing mechanism further comprising a trigger firing mechanism mechanically coupled to a trigger arm where the trigger arm is mechanically coupled to a target device where the trigger firing mechanism receives a third radio signal.

2. The device of claim 1, additionally comprising a camera attached to the target device.

3. The device of claim 1, additionally comprising a rangefinder attached to the target device.

4. The device of claim 1, additionally comprising a laser sight attached to the target device.

5. The device of claim 1, additionally comprising an auto feed mechanism mechanically coupled to a magazine.

6. The device of claim 1, where the target device is a paintball gun.

7. The device of claim 1, where the target device is a rocket launcher.

8. The device of claim 1, where the target device is a fire extinguisher.

9. The device of claim 1, where the target device is a grenade launcher.

10. The device of claim 1, where the target device is a sandblaster.

* * * * *